United States Patent [19]

Jacob

[11] 3,935,125

[45] Jan. 27, 1976

[54] METHOD AND COMPOSITION FOR INHIBITING CORROSION IN AQUEOUS SYSTEMS

[75] Inventor: Jose T. Jacob, Lake Zurich, Ill.

[73] Assignee: Chemed Corporation, Cincinnati, Ohio

[22] Filed: June 25, 1974

[21] Appl. No.: 482,941

[52] U.S. Cl...... 252/389 A; 21/2.5 A; 21/2.7 A; 106/14; 252/75; 252/8.55 E; 252/87; 252/181

[51] Int. Cl.[2]..... C23F 11/16; C23F 11/14

[58] Field of Search..... 252/389 A, 75, 77, 8.55 E, 252/181, 87; 21/2.7 A, 2.5 A; 106/14

[56] References Cited

UNITED STATES PATENTS

| | | | |
|---|---|---|---|
| 3,640,873 | 2/1972 | Avery et al. | 252/389 A |
| 3,736,110 | 5/1973 | Owston et al. | 252/389 A |
| 3,751,372 | 8/1973 | Zechs | 21/2.7 A |
| 3,787,319 | 1/1974 | Larsen | 21/2.7 A |
| 3,803,047 | 4/1974 | Hwa | 252/389 A |
| 3,816,333 | 6/1974 | King et al. | 252/389 A |

*Primary Examiner*—Leland A. Sebastian
*Assistant Examiner*—Irwin Gluck
*Attorney, Agent, or Firm*—Eugene M. Bond

[57] ABSTRACT

The invention disclosed relates to a method and composition for inhibiting corrosion in aqueous systems, the composition including a mixture of amine pyrophosphate, an organophosphonate, and a triazole. The composition provides a non-polluting corrosion inhibitive system which is especially useful in aqueous units constructed of ferrous and non-ferrous metals.

5 Claims, No Drawings

METHOD AND COMPOSITION FOR INHIBITING CORROSION IN AQUEOUS SYSTEMS

This invention relates to a method and composition for inhibiting corrosion in aqueous systems constructed of ferrous or non-ferrous metals. The present composition, formed of a mixture of amine pyrophosphate, organophosphonate and triazole, is especially effective in preventing corrosion of metal surfaces in contact with aqueous systems, while at the same time being non-polluting.

Numberous compositions are known to the art for inhibiting corrosion in aqueous systems. A number of these prior art compositions are based on chromates, heavy metals and phosphates. The residues from such compositions frequently may not be discharged into receiving waters due to restrictions in the amount of toxicants allowed. It has now been found, however, that by practice of the present invention there is provided a new improved aqueous corrosion inhibiting composition and method which not only effectively inhibits corrosion but also is readily disposed of after use, since it is non-polluting in nature. The non-polluting character of the present composition results since the composition is free of chromates, heavy metals and contains practically negligible amounts of phosphate. In addition to excellent corrosion inhibition, the present composition is also effective in reducing scale and fouling on heat transfer surfaces.

Generally stated, the present invention provides a corrosion inhibiting composition consisting essentially of an amine pyrophosphate, an organophosphonate, and a triazole; which are disposed in corrosion inhibiting amounts in an aqueous system.

Amine pyrophosphates used in the present composition include aliphatic, aromatic, and heterocyclic amines which form watersoluble salts with pyrophosphoric acid.

Amines which may be reacted to form water-soluble pyrophosphate salts include aliphatic amines having from 2 to 10 carbon atoms. Primary, secondary and tertiary amines may be used. Specific examples of useful aliphatic amines include lower alkyl amines, di-lower alkyl amines, and tri-lower alkyl amines, wherein the length of the alkyl group ranges from 2 to 10 carbon atoms.

Aromatic amines may also be reacted to form water-soluble salts useful herein. Examples of useful aromatic amines are aniline and substituted alkyl anilines where the alkyl-substituent ranges from 1 to 6 carbon atoms.

Heterocyclic amines may also be reacted to form water-soluble salts. Useful heterocyclic amines include pyrrole and substituted pyrroles, pyridine and substituted pyridine, etc.

Organophosphonates include alkylene polyphosphonic acids and/or mixtures thereof having one or more of the following formulae, A, B. or C:

Formula A

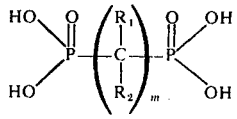

or

Formula B

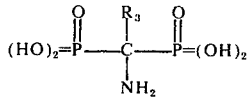

-continued or

Formula C

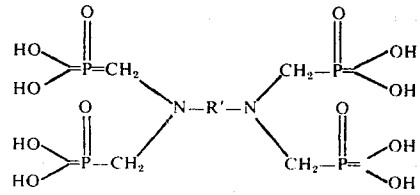

wherein $m$ is an integer from 1 to 10, $R_1$ is hydrogen, or an alkyl group having from 1 to 4 carbons and $R_2$ is hydroxyl, hydrogen, or an alkyl group having from 1 to 4 carbons, $R_3$ is an alkyl group having 1 to 10 carbons, benzyl of phenyl, R′ is an alkylene radical having from 1 to 10 carbons.

The preferred organo-phosphonic acid compound for use in the composition of this invention is an alkylene diphosphonic acid having the foregoing Formula A, such as those disclosed in U.S. Pat. Nos. 3,214,454 and 3,297,578, the entire disclosure of which is incorporated herein by reference. Suitable acids of this type include methylenediphosphonic acid; ethylidenediphosphonic acid; isopropylidenediphosphonic acid; 1-hydroxy, ethylidenediphosphonic acid; trimethylenediphosphonic acid; 1-hydroxy, propylidenediphosphonic acid; 1,3-dihydroxy, 1,3-dipropyl, trimethylenediphosphonic acid; dihydroxy, diethyl, ethylenediphosphonic acid; butylidenediphosphonic acid; 1-aminoethane-1,1-diphosphonic aicd; 1-aminopropane-1,1-diphosphonic acid; 1-aminobenzyl-1,1-diphosphonic acid; 1,6-diaminohexane-1,1,6,6-tetramethylphosphonic acid and 1-amino-2-phenylethane-1,1-diphosphonic acid. Water-soluble salts of these acids such as the alkali metal, alkaline earth metal, ammonium or amine and lower aklanol amine salts can be used. Use of mixtures of any of the general types of organophosphonic acid compounds described above is also contemplated within the scope of this invention.

The compositions of this invention also contain from 1 to 95 and preferably from 10 to 45 percent of a water-soluble triazole. The triazole may be any of a number of triazole moiety containing compounds. Examples of a useful triazole include benzotriazole; 1,2,3-triazole or derivative thereof having the formula:

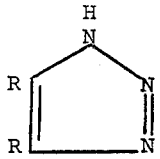

where R is H or an alkyl group of 1–4 carbon atoms, or an aromatic group or together form an aromatic or substituted aromatic ring. The preferred 1,2,3-triazole is benzotriazole (sometimes known as 1,2,3-benzotriazole), i.e.,:

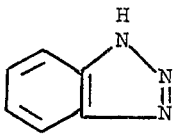

other suitable water-soluble derivates include, for example, 4-phenyl-1,2,3-triazole; 1,2,3-tolyltriazole, 4-methyl-1,2,3-triazole, 4-ethyl-1,2,3-triazole, 5-methyl-1,2,3-triazole, 5-ethyl-1,2,3-triazole, 5-propyl-1,2,3-triazole, and 5-butyl-1,2,3, triazole. Alkali metal or ammonium salts of 1,2,3-triazole or any of the above described derivatives thereof may also be used.

In the methods of this invention, corrosion is inhibited by maintaining in the aqueous fluid in contact with the metal surfaces to be protected an effective amount of the above described corrosion inhibiting composition. As will be apparent to those skilled in the art, the methods of this invention may also be practiced by separate introduction of the three essential corrosion inhibiting ingredients into the aqueous system in the following concentrations:

| Ingredient | Concentration (in ppm) Typical Effective | Preferred Range |
|---|---|---|
| Amine Pyrophosphate or derivative | about 0.5 to about 1,000 | About 3 to about 60 |
| Organophosphonate | about 0.5 to about 1,000 | about 1 to about 80 |
| Triazole or derivative | about 0.5 to about 200 | about 1 to about 60 |

The compositions of this invention are useful for treating a variety of aqueous systems, that is, any aqueous system corrosive to metal surfaces in contact therewith. Suitable systems which can be treated according to this invention include water treatment systems, cooling towers, water circulating systems, and the like wherein fresh water, brines, sea water, sewage effluents, industrial waste waters, and the like are circulated in contact with metal surfaces. These compositions are also useful in radiator coolers, hydraulic liquids, antifreezes, heat transfer mediums, and petroleum well treatments. The process of this invention is suitable for reducing the corrosion of iron, copper, aluminum, zinc and alloys containing these metals such as steel and other ferrous alloys, brass, and the like which are in contact with corrosive aqueous systems. The invention will be further understood from the following illustrative but non-limiting examples.

All concentrations are given herein as weight percent unless otherwise specified.

EXAMPLE 1

Corrosion tests were conducted on test coupons exposed for ten days in a simulated cooling tower system which included a treatment feed system and a cooling water recirculation system. Circulating water containing total dissolved solids 2000 ppm; calcium 135 ppm; magnesium, 49 ppm; bicarbonate, 134 ppm; chloride, 600 ppm; and sulfate 600 ppm was used. During the test, the circulating water, with or without treatment, depending upon the test underway, was fed to the circulating test system at a rate of 5 gallons per day, the overflow from the test system being discharged to waste.

In the circulating system, water having a temperature of 130° F (54° C) and pH of 6.5 to 7 was fed at a rate of 1 gallon per minute to a coupon chamber containing test coupons for the corrosion test. Water from the coupon chamber was then passed through an arsenical-admiralty brass tube surrounded by a jacket through which a heating fluid having an initial temperature of 240° Fahrenheit (116° Centigrade) was counter-currently passed. The circulating water was then cooled to 130° F and recirculated through the system. Total time for each test was 10 days.

Mild (SAE 1010) steel, brass (33 weight percent zinc), copper, and aluminum coupons having an average area of 26.2 square centimeters were used in the test chamber. In preparation for corrosion testing, each coupon was sandblasted and brushed to remove loosely held sand particles. After brushing, the specimens were successively immersed in running tap water, in distilled water, then dipped into isopropyl alcohol, followed by a dip into benzol. Upon removal from the benzol, the specimens were air dried and stored over calcium chloride in a desiccator. Each coupon was weighed just before use. Following the corrosion test, each coupon was cleaned with inhibited acid, rinsed, dried and weighed to determine the corrosion rate in mils per year (hereinafter referred to as MPY).

The testing system was pretreated in each test by adding five times the normal dosage of the treatment being tested to the circulating water during the startup of the test. Based on the treatment feed rate of 5 gallons per day, and the system volume of 2.9 gallons, pretreatment duration was about 14 hours for each corrosion test. In cooling water treatment, most methods of corrosion inhibition are based on forming a uniform impervious film that acts as a diffusion barrier to inhibit corrosion. The rate at which the protective film forms is determined largely by the concentration of the inhibitive composition. Since extensive corrosion data demonstrate the effectiveness of the pretreatment principle in decreasing initial corrosion rates, pretreatment procedure was followed in the tests.

TABLE I

Corrosion Measurements with Simulated Cooling Tower Unit

| Treatment | Corrosion Rate (MPY) 10 days, 130°F pH 7–8.5 Steel | Aluminum | Copper | Brass |
|---|---|---|---|---|
| Blank | 19.2 | 21 | 2.6 | 2.9 |
| *30 ppm dibutyl amine pyrophosphate + **10 ppm hydroxyethylidene diphosphonic acid + 5 ppm benzotriazole | 3.18 | 3.02 | 0.31 | 0.16 |
| *30 ppm dibutyl amine pyrophosphate + **10 ppm hydroxyethylidene diphosphonic acid + 5 ppm benzotriazole | 3 | 3.1 | 0.27 | 0.15 |
| *30 ppm dibutyl amine pyrophosphate + **10 ppm hydroxy ethylidene diphosphonic acid + 5 ppm benzotriazole | 3.2 | 3 | 0.3 | 0.17 |

*dibutyl amine pyrophosphate is 41.9% active
**hydroxy ethylidene diphosphonic acid is 60% active

TABLE II

| Corrosion Measurements with Simulated Cooling Tower Unit | Corrosion Rate (MPY) 10 days, 130°F. pH 7–8.5 | | | |
|---|---|---|---|---|
| Treatment | Steel | Aluminum | Copper | Brass |
| 10 ppm hydroxy ethylidene diphosphonic acid | 19.2 | 20 | 2.6 | 2.5 |
| 5 ppm benzotriazole | 13.0 | 9 | 0.41 | 0.48 |
| 30 ppm dibutyl amine pyrophosphate | 11 | 6 | 0.4 | 0.3 |
| 10 ppm hydroxy ethylidene diphosphonic acid + 5 ppm benzotriazole | 13.9 | 9.05 | 0.41 | 0.48 |
| 10 ppm hydroxy ethylidene diphosphonic acid + 30 ppm dibutyl amine pyrophosphate | 10 | 4 | 0.3 | 0.27 |
| 30 ppm dibutyl amine pyrophosphate + 5 ppm benzotriazole | 10 | 4 | 0.3 | 0.15 |
| 30 ppm dibutyl amine pyrophosphate + 10 ppm hydroxy ethylidene diphosphonic acid + 5 ppm benzotriazole | 3 | 3.1 | 0.27 | 0.15 |

TABLE III

| Scale Deposit Measurement Using Heat Exchange Tube on Simulated Cooling Tower Unit | |
|---|---|
| Treatment | Weight per 2 ft. Length (grams) |
| Blank | 3.0 |
| 30 ppm dibutyl amine pyrophosphate + 10 ppm hydroxy ethylidene diphosphonic acid + 5 ppm benzotriazole | 0.08 |

It will be seen from the above examples that dibutylamine pyrophosphate, hydroxy ethylidene diphosphonic acid and benzotriazole in the weight ratio of 2.6:1.2:1 will give complete protection for mild steel, brass, aluminum and copper (Table I). The inhibition property is found to be synergistic in nature (Table II). It not only reduces corrosion, but reduces scale and fouling on heat transfer tube surfaces (Table III).

It is understood that the foregoing detailed description is given merely by way of illustration and that many variations may be made therein without departing from the spirit of this invention.

What is claimed is:

1. A composition for inhibiting corrosion in aqueous systems, said compositions consisting essentially of watersoluble amine pyrophosphate, organophosphonate and triazole; wherein the amine pyrophosphate has from 2 to 10 carbon atoms; wherein the organophosphonate has a formula of the group consisting of:

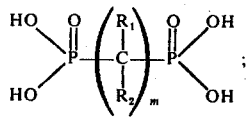

;

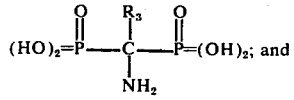

; and

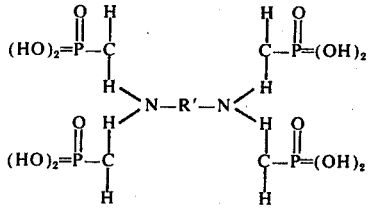

wherein $m$ is an integer from 1 to 10; $R_1$ is hydrogen, or alkyl group having from 1 to 4 carbons; $R_2$ is hydroxyl, hydrogen or alkyl group having from 1 to 4 carbons; $R_3$ is an alkyl group having 1 to 10 carbons, benzyl or phenyl, and R′ is an alkylene radical having from 1 to 10 carbons; and water soluble salts of these acids; and wherein the triazole is a member of the group consisting of benzotriazole; 1,2,3-triazole or derivative thereof having the formula:

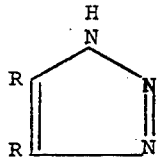

where R is H or an alkyl group of 1–4 carbon atoms, or an aromatic group, or together from an aromatic or substituted aromatic ring; and water soluble salts, and wherein the amine pyrophosphate is present in an amount from about 0.5 to about 1,000 ppm; the organophoshonate is about 0.5 to about 1,000 ppm; and the triazole is about 0.5 to about 200 ppm of water.

2. The composition of claim 1 wherein the amine pyrophosphate is present in an amount from about 3 to about 60 ppm; the organophosphonate is about 1 to about 80 ppm; and the triazole is about 1 to about 60 ppm.

3. A composition for inhibiting corrosion according to claim 1 wherein the amine pyrophosphate is dibutylamine pyrophosphate, the organophosphonate is 1-hydroxyethylidene, 1,1-diphosphonic acid, and the traizole is benzotriazole.

4. The method of claim 1 wherein the amine pyrophosphate is present in an amount from about 3 to about 60 ppm; the organophosphonate is about 1 to about 80 ppm; and the triazole is about 1 to about 60 ppm.

5. A method for inhibiting corrosion in aqueous systems, said method comprising maintaining therein a corrosion inhibiting amount of the composition of claim 1.

* * * * *